United States Patent [19]

Trütschel

[11] 4,381,655

[45] May 3, 1983

[54] MACHINE FOR TREATING HIDES OR THE LIKE

[75] Inventor: Willi Trütschel, Rosbach, Fed. Rep. of Germany

[73] Assignee: Maschinenfabrik Moenus AG, Frankfurt, Fed. Rep. of Germany

[21] Appl. No.: 212,603

[22] Filed: Dec. 3, 1980

[30] Foreign Application Priority Data

Dec. 4, 1979 [DE] Fed. Rep. of Germany ..... 2948719

[51] Int. Cl.[3] ..... A43D 89/00; C14B 17/14

[52] U.S. Cl. ..... 69/38; 69/42; 12/34

[58] Field of Search ..... 69/42, 43, 38, 39; 12/34

[56] References Cited

U.S. PATENT DOCUMENTS

| | | | |
|---|---|---|---|
| 891,787 | 6/1908 | Teel | 69/38 |
| 1,239,748 | 9/1917 | Travis | 69/38 |
| 1,625,981 | 4/1927 | Brophy et al. | 69/38 |
| 3,319,442 | 5/1967 | Burch | 69/42 |

*Primary Examiner*—Patrick D. Lawson

*Attorney, Agent, or Firm*—Kontler, Grimes & Battersby

[57] ABSTRACT

A tanning machine wherein a pressure roller urges one side of a hide or skin against the blades of an elongated rotary severing device has a grinding unit which treats the blades of the severing device and is mounted in the frame of the tanning machine. The grinding unit has elongated straight first guide members which are fixedly mounted in the frame and extend in parallelism with the axis of the severing device, a first carriage which is reciprocable along the first guide members by a motor through the medium of an endless chain and carries second guide members extending radially of the severing device, a second carriage which is reciprocable along the second guide members and supports a grinding tool, and a cam and follower arrangement which moves the second carriage along the second guide members in response to reciprocation of the first carriage along the first guide members. The cam is preferably an elongated template which is mounted on the first guide members and has a cam face facing away from the severing device. The follower is a roller which is mounted on the second carriage and is biased against the cam face by a spring which reacts against the first carriage and bears against the second carriage.

11 Claims, 8 Drawing Figures

MACHINE FOR TREATING HIDES OR THE LIKE

BACKGROUND OF THE INVENTION

The present invention relates to machines for treating hides, skins or the like, and more particularly to improvements in tanning machines of the type wherein a skin or hide (hereinafter referred to as hide with the understanding, however, that the term is intended to embrace hides as well as skins or sides of dead animals) is treated by a rotary severing tool (also called knife cylinder) while one side thereof bears against the cylindrical or substantially cylindrical peripheral surface of a pressure roller or another suitable back support. Still more particularly, the invention relates to improvements in tanning machines of the just outlined character wherein the severing tool cooperates with a grinding tool which is reciprocable lengthwise or substantially axially of the severing tool along a path which is not a straight linear path.

The commonly owned German Auslegeschrift No. 16 60 098 discloses a tanning machine wherein the grinding tool is mounted directly on a support which is reciprocable lengthwise of the rotary severing tool. The support is elastically deformable with reference to a rigid traverse or crosshead so as to ensure that the width of the nip or gap between the rotating severing tool and the aforementioned pressure roller can vary as considered in the longitudinal direction of the severing tool. This is accomplished by changing the configuration of the severing tool, i.e., by ensuring that portions of the peripheral surface of the severing tool are not true cylindrical surfaces. Such configuration of the aforementioned nip or gap is desirable in connection with the treatment of certain hides, namely, of hides wherein relatively hard portions alternate with softer portions. In many instances, the hide is softer at the sides and is much harder in the middle, it being assumed that the hide is formed in the customary manner, namely, by splitting the carcass at the underside of the neck and thereupon between the front legs and on toward and between the hind legs. When a hide is formed in the just outlined manner, the width of the gap portions which allow for passage of softer portions of the hide is normally greater than the width of those portions of the gap which allow for the passage of harder sections of the hide.

As a rule, the deviation of the path for the grinding tool from a straight line is in the range of a few tenths of one millimeter because the elasticity of parts which carry the grinding tool is necessarily limited, i.e., each such part must exhibit a certain amount of stability which precludes excessive deviations of the width of the gap from an average width.

The aforementioned German Auslegeschrift further discloses a modified machine wherein the grinding tool moves along a partially arcuate path as a result of tilting of its support relative to a guide means. To this end, the support is provided with two rolls which track the non-deformable guide means and with a roller follower which extends into an elongated groove. The configuration of the groove is such that is causes tilting of the support relative to the guide means during certain stages of its movement lengthwise of the severing tool. A drawback of the just discussed modification of the patented machine is that here, too, the extent to which the grinding tool can move at right angles to the axis of the rotating severing tool is in the range of a few tenths of one millimeter. If the extent of radial movement of the grinding tool with respect to the severing tool would exceed such relatively low value, the three-point contact between the grinding tool and its guide means would fail to ensure adequate guidance of the grinding tool while the machine is in actual use.

Owing to aforediscussed slight deviation of the peripheral surface of the severing tool from a true cylindrical surface, the machine of the German Auslegeschrift cannot be used for removal of flesh (fleshing or refleshing) from the inner side of the hide. All the prior machine can do is to serve as an equalizing or shaving machine, i.e., it can perform functions of the type where minor deviations of the path for the grinding tool from a true straight path suffice to properly treat successive hides. However, and as is the case with fleshing or refleshing machines which are used to remove meat from the inner side of the hide and wherein the gap between the severing tool and the pressure roller must exhibit relatively narrow as well as rather wide portions (i.e., where the difference between the maximum and minimum widths of the gap is more than one or more tenths of one millimeter), the machine of the German Auslegeschrift is incapable of operating in a satisfactory way. Depending on the condition (nature of treatment) of the hide (e.g., whether or not the hide was treated with lime or for the purpose of increasing its softness), it is often necessary that the difference between the maximum and minimum widths of the gap between the severing tool and the pressure roller be in the range of 2–6 millimeters. The just mentioned difference also depends, at least to a certain extent, on the nature of the hide, e.g., whether the hide is a cowhide, a sheepskin or the hide or skin of another animal.

For the aforementioned reasons, a fleshing or refleshing machine which is used to remove meat from the hide invariably utilizes a cylindrical severing tool and the width of the gap between the severing tool and the back support is varied by deforming the back support. For example, it is known to utilize a back support in the form of a hose which is filled with air or another gas at a given pressure so that it can yield during passage of a hide through the gap between the peripheral surface of such hose and the severing too. It is also known to use a back support in the form of a steel roller whose diameter is sufficiently small to allow for appreciable flexing and attendant changes in the width of the gap between the steel roller and the rotary severing tool. In such instances, the hose and/or the steel roller cannot rotate during passage of a hide through the gap. This presents problems, especially as concerns the extent of wear. Thus, the wear upon the hose or roller as a result of frictional engagement with the hide and/or severing tool is so pronounced that it can lead to undesirable changes in the width of the gap.

OBJECTS AND SUMMARY OF THE INVENTION

An object of the invention is to provide a novel and improved machine for treating hides wherein the width of the nip or gap through which the hide passes during treatment by a rotary severing device can be varied within a desired range and in a novel and improved way.

Another object of the invention is to provide novel and improved means for treating the cutting edges of the severing device in a tanning machine of the above outlined character.

A further object of the invention is to provide novel and improved means for imparting movements to the means for treating the severing device in the above outlined tanning machine.

An additional object of the invention is to provide the machine with novel and improved means for guiding the grinding tool for the rotary severing device which treats the hide during transport of the hide through the gap between the severing device and a rotary or stationary pressure roller or an analogous back support.

A further object of the invention is to provide the machine with novel and improved means for selecting the width of the gap between the severing device and the pressure roller.

The invention is embodied in a tanning machine, especially a fleshing or refleshing machine, which comprises a frame, an elongated severing device which is rotatably mounted in the frame, and grinding means for the severing device. The grinding means comprises stationary straight first guide means mounted in the frame and extending in parallelism with the axis of the severing device, a first carriage which is reciprocable along the first guide means, means for reciprocating the first carriage along the first guide means, second guide means mounted on the first carriage and extending substantially radially of the severing device, a second carriage which is reciprocable along the second guide means, a grinding tool for the severing device on the second carriage, and means for moving the second carriage with the grinding tool along the second guide means in response to reciprocation of the first carriage along the first guide means.

The means for moving the second carriage preferably comprises cam means (preferably an elongated template) mounted in the frame (e.g., on the first guide means) and having a cam face extending in substantial parallelism with the first guide means. The deviations of the cam face from a position of parallelism with the first guide means (which is straight) determine the extent to which the second carriage (and hence the grinding tool) is reciprocable along the second guide means in response to reciprocation of the first carriage along the first guide means.

The moving means further comprises follower means which is provided on the second carriage and a spring or other suitable means for biasing the follower means against the cam face. The latter preferably faces away from the severing device; this is desirable on the ground that the follower means need not track the face of the cam means when the resistance which the severing device offers to such tracking exceeds a preselected value, e.g., when the blades of the severing device are relatively new and offer a pronounced resistance to removal of material by the grinding tool.

The novel features which are considered as characteristic of the invention are set forth in particular in the appended claims. The improved tanning machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
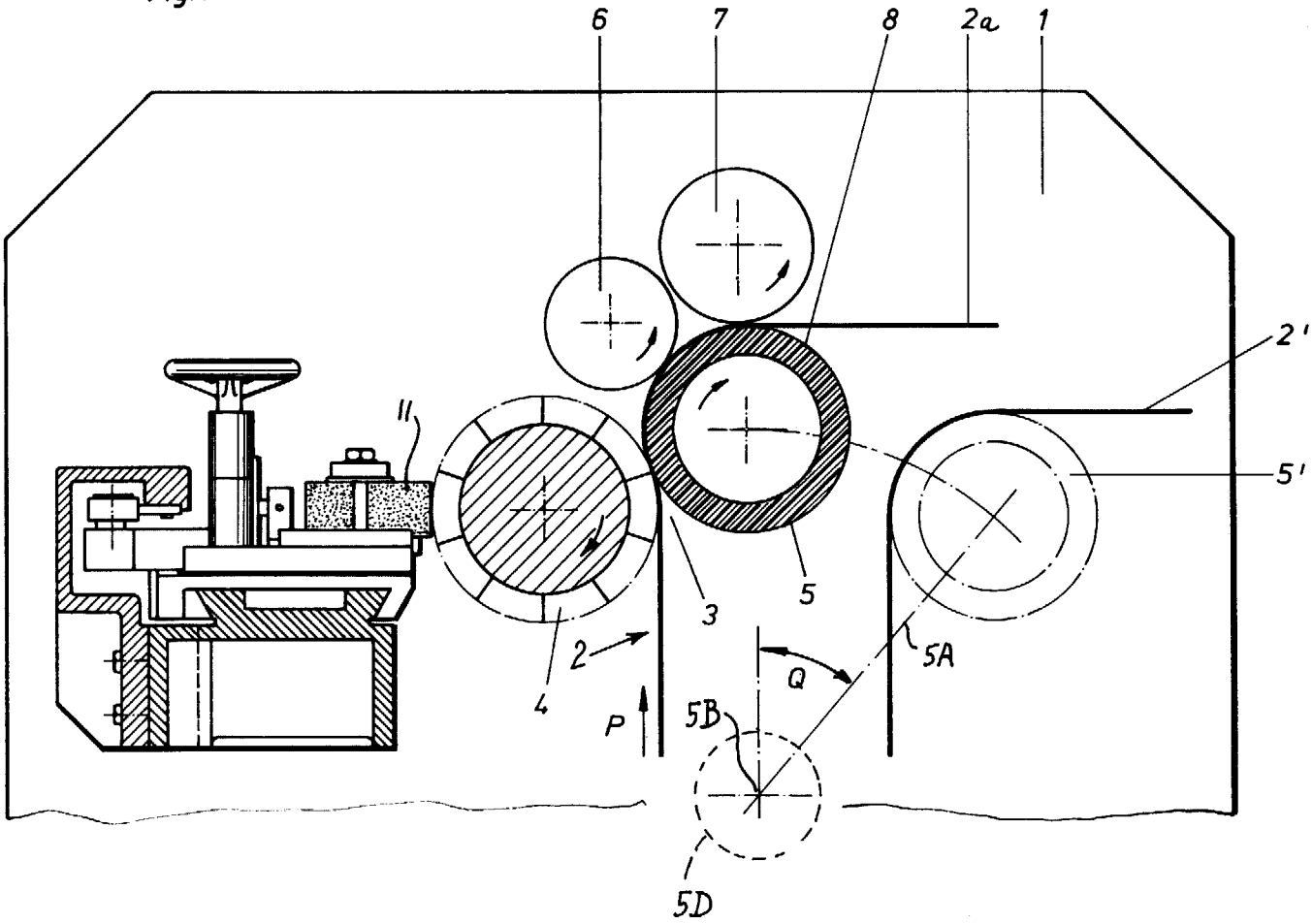
FIG. 1 is a somewhat schematic fragmentary vertical sectional view of a tanning machine which embodies one form of the invention.

FIG. 1 illustrates a frame member 1 which form part of the frame of a tanning (fleshing) machine for removing flesh from hides 2. During treatment, the hide 2 is caused to advance in the direction of arrow P through the elongated narrow nip or gap 3 between a rotary cutting or severing device 4 (hereinafter called knife for short) and a rotary pressure roller or back support 5. The means for transporting the hide 2 through the gap 3 between the knife 4 and the back support 5 includes two advancing rolls 6 and 7 which are located downstream of the gap 3, as considered in the direction of the arrow P, and cooperate with the back support 5. The latter is provided with a peripheral layer 8 of rubber or other suitable elastomeric material against which the respective side of the hide 2 is biased by the advancing rolls 6 and 7 when the back support 5 assumes the solid-line or operative position of FIG. 1. The back support 5 is movable between such solid-line or operative position and a phantom-line or inoperative position 5' in which its peripheral layer 8 is remote from the knife 4. This renders it possible to conveniently introduce the leader 2*a* of the hide 2 (in the position 2') into the machine before the back support 5 is returned to the solid-line position and thereby moves one side of the hide 2 into requisite contact with the blades of the knife 4. The back suppoort 5 is mounted on the upper end portion of a lever 5A which is fulcrumed in the frame, as at 5B, and can pivot through an angle Q to thereby move the back support 5 between the solid-line and phantom-line positions of FIG. 1. The means for pivoting the lever 5A comprises a fluid-operated rotary piston motor 5D the details of which form no part of the present invention. Such motor can move the back support or pressure roller 5, up to 1600 times per hour, between the solid-line and broken-line positions of FIG. 1.

Figures 6, 7, 8:
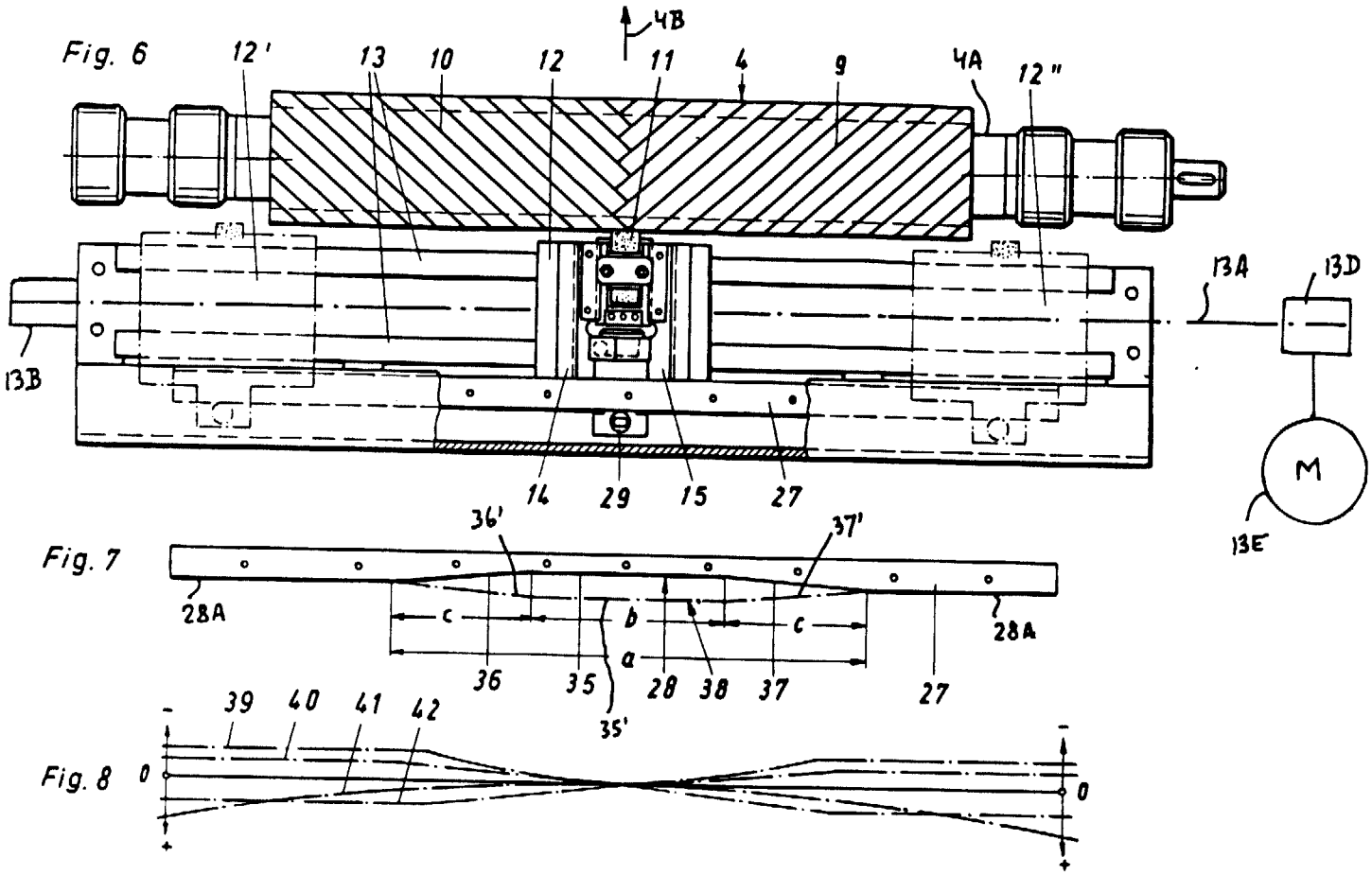
FIG. 6 is a plan view of the severing device and of the entire grinding means.
FIG. 7 is a plan view of an elongated cam which can be used in the grinding means of the improved machine, another form of the face of the cam being indicated by phantom lines.
FIG. 8 illustrated four additional shapes of the face of a cam which can be used in the grinding means of the improved tanning machine.

As shown in FIG. 6, the knife 4 comprises a cylindrical or substantially cylindrical core 4A for two sets of helical blades 9 and 10 which are inclined in the opposite directions and meet in the region of the plane which extends at right angles to the axis of and halves the core 4A. The direction of rotation of the knife 4 is such that the blades 9 and 10 produce a stretching or expanding (setting-out) effect upon the hide 2 in the gap 3. In other words, and referring to FIG. 6, the core 4A of the knife 4 is caused to rotate in the direction which is indicated by the arrow 4B. FIG. 1 shows that the knife 4 rotates in the same direction (clockwise) as the pressure roller or back support 5, and that the advancing rolls 6 and 7 rotate in the opposite direction (counterclockwise).

Figure 3:
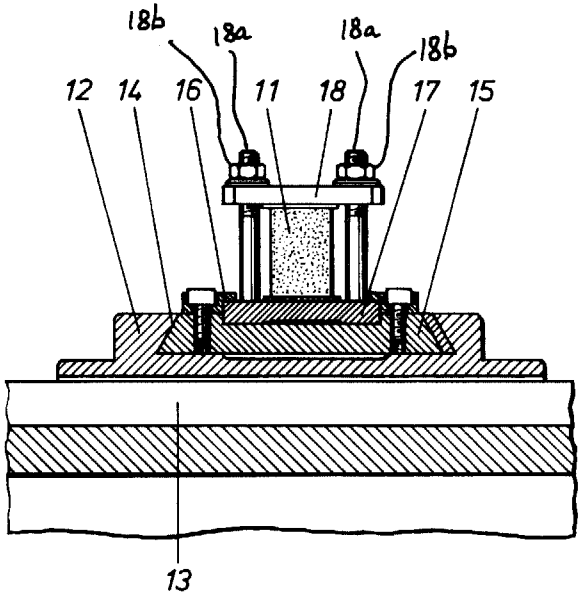
FIG. 3 is a fragmentary longitudinal vertical sectional view of the grinding means.
Figure 2:
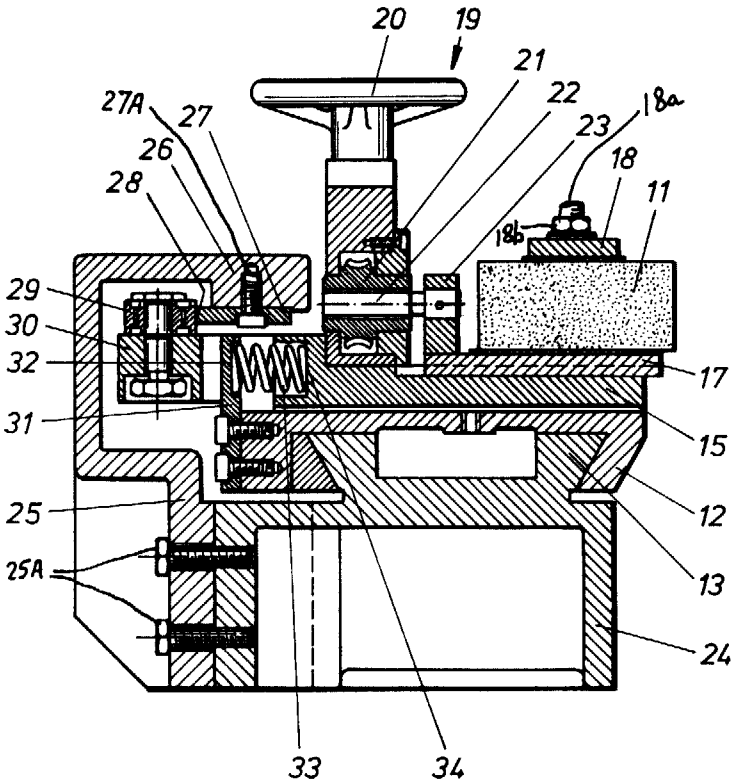
FIG. 2 is an enlarged transverse sectional view of the grinding means for the rotary severing device in the machine of FIG. 1.
Figure 4:
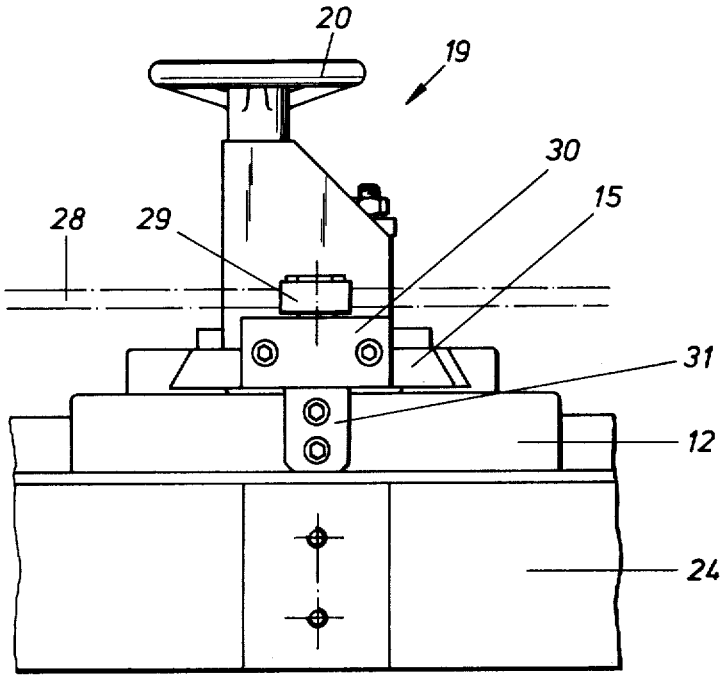
FIG. 4 is a fragmentary rear elevational view of the grinding means as seen from the left-hand side of FIG. 2.
Figure 5:
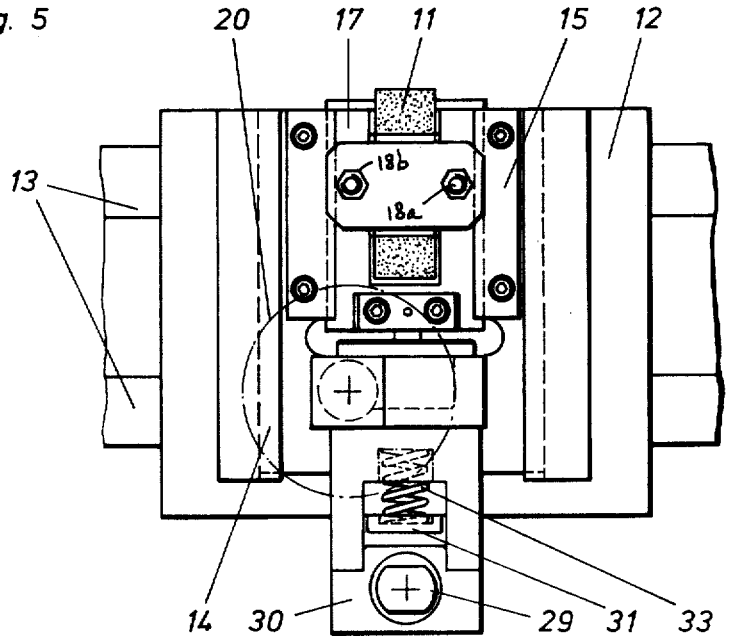
FIG. 5 is a fragmentary plan view of the grinding means with the hand wheel of the grinding means indicated by a phantom-line circle.

The cutting edges of the blades 9 and 10 on the core 4A of the knife 4 are treated by a grinding tool 11 in the form of an elongated block or brick (see particularly FIGS. 2 and 3) which is disposed substantially radially of the knife 4. The grinding tool 11 ensures that the cutting edges of the blades 9 and 10 remain smooth. It goes without saying that the block-shaped grinding tool 11 can be replaced with a grinding wheel, especially upon insertion of a fresh knife 4 so as to impart to the cutting edges of the blades 9 and 10 a desired (optimum) shape.

The grinding tool 11 is mounted on a first carriage 12 which is reciprocable along elongated guide members 13. The carriage 12 can be moved between a first end position 12' and a second end portion 12". These end positions are shown in FIG. 6 by phantom lines; it will be noted that the length of travel of the carriage 12 along the guide members 13 suffices to ensure adequate treatment of each and every portion of each and every blade 9 or 10 by the grinding tool 11. The guide members 13 are parallel to each other and to the axis of the knife 4.

The carriage 12 supports a second carriage or slide 15 which is reciprocable transversely of the knife 4, i.e., substantially at right angles to the axis of the knife 4. To this end, the carriage 12 is provided with or supports additional guide members 14 which extend at right angles to the guide members 13 and enable the carriage 15 to move the grinding tool 11 toward or away from the axis of the core 4A. The second carriage 15 is provided with or supports third guide members 16 (see particularly FIG. 3) which are parallel to the guide members 14 and serve to guide a plate-like holder 17 for the grinding tool 11. The grinding tool 11 is separably attached to the holder 17 by a clamping device including two upright bolts **18*a* which flank the tool 11 and a crosshead 18 which has holes for the upper end portions of the bolts 18*a* and is biased against the top face of the tool 11 by nuts 18*b*** meshing with the externally threaded upper end portions of the bolts.

The means 19 for adjusting the position of the holder 17 relative to the second carriage or slide 15, i.e., for moving the holder 17 lengthwise of the third guide members 16, comprises a hand wheel 20 which can rotate a worm wheel 21 having internal threads mating with the external threads of a feed screw 22 connected to an extension 23 of the holder 17.

The guide members 13 constitute component parts of an elongated beam 24 one side face of which is adjacent to a carrier or support 25. The latter is secured to the beam 24 by screws 25A or analogous fastener means (see FIG. 2). The upper portion 26 of the carrier 25 supports an elongated cam 27 which is secured to the portion 26 by screws or analogous fasteners 27A and has an elongated cam face 28 which is tracked by a roller follower 29. The cam face 28 faces away from the grinding tool 11 and knife 4, and the follower 29 is mounted on an extension or arm 30 of the second carriage 15. The carriage 12 is connected with a plate-like retainer 31 having an abutment surface 32 for a helical spring 33 which bears against a surface 34 of the second carriage 15 and urges the roller follower 29 against the face 28 of the cam 27.

The carriage 12 is reciprocable along the guide members 13 by a chain 13A which is trained over sprocket wheels 13B, 13D (see FIG. 6). The sprocket wheel 13D is driven by a reversible electric motor 13E which is mounted in the frame including the frame member 1.

The manner in which the knife 4 and the advancing rolls 6, 7 are driven forms no part of the invention and is not illustrated. For example, the knife 4 may be rotated by a discrete electric motor through the medium of one or more V-belts, and the core 4A of the knife 4 may drive a pump which supplies fluid to the rotary piston motor 5D shown in FIG. 1. The advancing rolls 5 and 6 can be driven by a discrete prime mover through the medium of a variable-speed transmission. The machine preferably comprises means for automatically arresting the various motors, or at least the motor for the knife 4, when the pressure roller 5 is moved to the phantom-line position 5' of FIG. 1.

FIG. 7 is a top plan view of the elongated cam 27. The face 28 of this cam has two coplanar parallel sections 28A flanking a stretch a wherein the face 28 is recessed behind the sections 28A so that the spring 33 causes the roller follower 29 to move the second carriage 15 along the guide members 14 (i.e., relative to the carriage 12) while the carriage 12 moves between the positions 12' and 12" as long as the follower 29 tracks the sections 36, 35 and 37 of the face 28. The median portion b of the stretch a is adjacent to the section 35 which is parallel to the sections 28A so that the position of the carriage 15 relative to the carriage 12 remains unchanged while the follower 29 tracks the section 35. The portions c of the stretch a are adjacent to the cam face sections 36 and 37 which are inclined with respect to the sections 28A and 35 and which thus cause the roller follower 29 and/or the spring 33 to shift the carriage 15 relative to the carriage 12 while the latter travels along the guide members 13. The sections 28A and 35 of the cam face 28 are parallel to the axis of the knife 4. The sections 36 and 37 are preferably (or can be) straight but are sufficiently inclined to cause the grinding tool 11 to move transversely of the axis of the core 4A of the knife 4 while the holder 12 moves between the end positions 12' and 12". It will be noted that the configuration of the cam face 28 is selected for the purpose of ensuring that the width of the median portion of the gap 3 exceeds the width of the marginal or outer portions of the gap and also that the transition from the wider median portion toward the narrower outer portions of the gap 3 is gradual owing to relatively slight inclination of the sections 36, 37 relative to the sections 35 and 28A.

FIG. 7 illustrates by phantom lines (at 38) the central portion of a modified cam face which includes the parallel coplanar sections 28A, a central section 35' which is parallel to the sections 28A and two intermediate sections 36', 37' which flank the section 35' and are inclined with reference to the sections 28A and 35'. Such a cam face causes the width of the gap to decrease in directions from the ends toward the median portion of the gap. All sections of the modified cam face 38 are preferably straight sections; this facilitates the machining of such cam face. The same applies for the face 28 of the cam 27. The difference between the cams including the faces 28 and 38 is that one of these cams causes the knife to exhibit a smaller-diameter median portion and two larger-diameter end portions whereas the other cam causes the knife to exhibit a larger-diameter median portion and two smaller-diameter end portions.

FIG. 8 shows several other presently preferred configurations of the face of the cam which guides the roller follower 29 and hence the carriage 15 during movement of the carriage 12 along the guide members 13. The cam face 39 of FIG. 8 exhibits a peak midway between its ends, i.e., it is analogous to the cam face 38 of FIG. 7 except that the length of the median section (corresponding to the median section 35' of the cam face 38) is zero or practically zero. Also, the projecting central sections of the cam face 39 have an arcuate (convex) shape, i.e., they are not flat as in the embodiments which are shown in FIG. 7.

The cam face 40 of FIG. 8 resembles the cam face 39 except that the projecting part of this cam face includes two flat sections which meet at the apex of the projecting portion of the cam face 39.

The cam face 41 of FIG. 8 is concave all the way from the one to the other end thereof so that the roller follower 29 moves the carriage 15 gradually away from and thereupon gradually toward the axis of the knife 4 while the carriage 12 travels between the end positions 12' and 12''.

The cam face 42 can be said to be a mirror image of the cam face 40, i.e., it comprises two flat parallel coplanar outer sections, and two flat median sections which meet at the apex of the cam face 39 or 40.

As shown in FIGS. 7 and 8, each of the cam faces 28, 38, 39, 40, 41 and 42 comprises two substantially or exactly mirror symmetrical halves (with reference to a plane which is normal to the longitudinal direction and halves the respective cam). Such types of cam faces are provided on cams which are used for treatment of entire hides or skins, i.e, of hides or skins including two mirror symmetrical halves at the opposite sides of the plane which is normal to the axis of and halves the knife 4.

It is also within the purview of the invention to use the improved machine for the treatment of portions (e.g., sides or halves) of animal hides or skins. The cams whose faces are shown in FIG. 7 or 8 are then replaced with cams having asymmetrical cam faces which allow for adequate treatment of portions of hides or skins. The length of the cam and the configuration of its face depend on the dimensions of the hides or skins. Any further deviations of the hide or skin which passes through the gap 3 from an anticipated norm are compensated for by elasticity of the peripheral layer 8 of the pressure roller or back support 5. Some such compensation also takes place as a result of the tendency of the cutting edges 9 and 10 to spread the hide or skin which passes through the gap 3, i.e., to flatten and expand the hide or skin owing to mutual inclination of the cutting edges 9 and 10.

It will be noted that the improved tanning machine comprises a grinding means with straight guide members 13 for the first or main carriage 12 and that the second carriage or slide 15 is reciprocable along guide members 14 which are mounted on the carriage 12 and extend transversely of the guide members 13, i.e., substantially radially of the knife 4. The cam 27, which is replaceable with little loss in time, controls the extent of movement of the carriage or slide 15 toward or away from the axis of the core 4A while the carriage 12 is caused to move between the end positions 12' and 12''. The cam 27 is an elongated template which is substantially parallel to the axis of the knife 4.

The just described construction of the grinding means ensures that the movements of the grinding tool 11 in directions at right angles to the axis of the knife 4 are not limited to small fractions of one millimeter. Instead, the face 28 of the cam 27 or the face of another cam which is mounted in the grinding means can be readily designed in such a way that the extent of movement of the tool 11 at right angles to the axis of the knife 4 is within a range of one or more millimeters, e.g., between 2 and 6 millimeters. Thus, such movement is a multiple of the movement at right angles to the direction of the knife axis in conventional machines. In spite of the movability of the grinding tool 11 through a distance of several millimeters (as considered at right angles to the axis of the knife 4), the stability of the grinding means is highly satisfactory because the guide means 13, 14 and 16 are straight, i.e., each of the two carriages 12, 15 and the holder 17 for the grinding tool 11 is reciprocable along a straight path. Also, such parts need not be tilted as in certain prior art tanning machines. Therefore, the improved machine can be used as a fleshing or refleshing machine for hides or skins of the type which can be properly treated only if the width of the gap 3 between the pressure roll or back support 5 and the knife 4 varies within a rather wide range, such as between 2 and 6 mm. Such variations of the width of the gap 3 can be achieved without resorting to a non-rotatable back support, such as the aforediscussed air-filled hose or small-diameter cylinder of a conventional fleshing or refleshing machine.

The elongated one-piece cam or template 27 or an analogous cam exhibits the important advantage that it can be readily replaced with a different cam. The provision of the coil spring 33 ensures that the roller follower 29 is invariably biased against the cam face 28 (or another cam face, depending on the selection of the cam for use in the grinding means), i.e., the width of the gap 3 always varies in accordance with a preselected pattern which is best suited for the treatment of a particular hide or series of hides. It has been found that the spring-biased roller follower 29 is much more likely to guarantee predictable movements of the tool 11 transversely of the rotating knife 4 than an arrangement wherein a roller follower is guided in a cam groove. When the roller follower extends into a cam groove, at least some play is unavoidable if one desires to reduce the likelihood of jamming of the roller follower; moreover, the wear upon the surfaces flanking the cam groove rapidly contributes to deviation of the width of the gap from an optimum value.

An advantage of the feature that the face of the cam 27 faces away from the tool 11 and knife 4 is that the roller follower 29 can be readily lifted off the cam face (against the opposition of the spring 33) if the resistance of the blades 9 and 10 to continuous tracking of the selected cam face by the roller follower 29 is relatively high. This can take place in response to insertion of a fresh knife 4 into the frame of the improved tanning machine. The placing of the spring 33 between a surface (34) of the carriage 15 and the retainer 31 on or in the carriage 12 constitutes a simple and space-saving solution of the problem of biasing the roller follower 29 against the cam face of the cam on the portion 26 of the beam 24. The beam 24 and the portion 26 of the support 25 can be said to constitute integral parts of the guide members 13 for the carriage 12 (or vice versa).

Adjustments of the position of the grinding tool 11 by means of the hand wheel 20 will take place to compensate for wear upon the knife 4 and/or tool 11. Moreover, such adjustments will be carried out when one desires to impart to the rotary knife 4 a predetermined shape which is especially suited for the treatment of a given series of hides or skins.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a tanning machine, the combination of a frame; an elongated severing device rotatably mounted in said frame; and grinding means for said severing device, including stationary straight first guide means mounted in said frame and extending in parallelism with the axis of said severing device, a first carriage reciprocable along said guide means, means for reciprocating said carriage along said guide means, second guide means mounted on said carriage and extending substantially radially of said severing device, a second carriage reciprocable along said second guide means, a grinding tool for said severing device, said tool being mounted on said second carriage, and means for moving said second carriage with said grinding tool along said second guide means in response to reciprocation of said first carriage along said first guide means.

2. The combination of claim 1, wherein said means for moving said second carriage comprises cam means mounted in said frame and having a cam face extending in substantial parallelism with said first guide means.

3. The combination of claim 2, wherein said cam means comprises an elongated template.

4. The combination of claim 2, wherein said moving means further comprises follower means provided on said second carriage and means for biasing said follower means against said cam face.

5. The combination of claim 2, wherein said cam face faces away from said severing device and said second carriage includes follower means tracking said cam face.

6. The combination of claim 1, wherein said moving means includes support means rigid with said first guide means, cam means secured to said support means, follower means provided on said second carriage, and means for biasing said follower means against said cam means.

7. The combination of claim 6, wherein said biasing means includes resilient means reacting against said first carriage.

8. The combination of claim 1, further comprising third guide means provided on said second carriage and extending substantially radially of said severing device, holder means reciprocable along said third guide means, means for securing said grinding tool to said holder means, and means for adjusting said tool including means for moving said holder means relative to said third guide means.

9. The combination of claim 8, wherein said means for moving said tool includes a manually operable device.

10. The combination of claim 1, wherein said severing device includes means for fleshing the hides or skins.

11. The combination of claim 1, further comprising a pressure roller movable in said frame between first and second positions in which said roller is respectively remote from and adjacent to said severing device, and means for moving said pressure roller between said positions, said roller and said severing device defining a gap for the passage of hides or skins in the second position of said roller.

* * * * *